US009730848B2

(12) United States Patent
Gardner

(10) Patent No.: US 9,730,848 B2
(45) Date of Patent: Aug. 15, 2017

(54) PERSONAL LIFT APPARATUS FOR USE WITH A BATHTUB

(71) Applicant: Roger R. Gardner, Yakima, WA (US)

(72) Inventor: Roger R. Gardner, Yakima, WA (US)

( * ) Notice: Subject to any disclaimer, the term of this patent is extended or adjusted under 35 U.S.C. 154(b) by 135 days.

(21) Appl. No.: 14/156,448

(22) Filed: Jan. 15, 2014

(65) Prior Publication Data

US 2015/0196444 A1 Jul. 16, 2015

(51) Int. Cl.
*A47K 3/02* (2006.01)
*A61G 7/10* (2006.01)

(52) U.S. Cl.
CPC ..... *A61G 7/1003* (2013.01); *A61G 7/1019* (2013.01); *A61G 7/1059* (2013.01); *A61G 7/1076* (2013.01); *A61G 2200/34* (2013.01)

(58) Field of Classification Search
CPC .. A61G 7/1003; A61G 7/1005; A61G 7/1019; A61G 7/1076
USPC ..... 4/562.1, 496; 5/87.1
See application file for complete search history.

(56) References Cited

U.S. PATENT DOCUMENTS 3,815,163 A * 6/1974 Sullivan ..... A61G 7/1003 4/562.1
3,914,808 A * 10/1975 Woods ..... A61G 7/1019 5/83.1
3,994,030 A * 11/1976 Cassell ..... A61G 7/1003 4/563.1
4,075,719 A * 2/1978 Sullivan ..... A61G 7/1003 254/93 R
4,206,523 A * 6/1980 James ..... A61G 7/1019 4/562.1
4,221,008 A * 9/1980 Nolan ..... A61G 7/1005 4/496
4,628,550 A * 12/1986 Walton ..... A47K 3/122 4/559
4,905,327 A * 3/1990 Boublil ..... A61G 7/1003 4/562.1
4,941,216 A * 7/1990 Boublil ..... A61G 7/1005 212/253
5,226,183 A * 7/1993 Clark ..... A61G 7/1003 4/560.1
5,715,545 A * 2/1998 Forwick ..... A61G 7/1003 4/563.1
6,070,278 A * 6/2000 Smith ..... A61G 7/1005 4/496
6,256,807 B1 * 7/2001 Steadman ..... A61G 7/1003 4/561.1

FOREIGN PATENT DOCUMENTS

DE 19840854 A1 * 3/2000 ..... A61G 7/053

* cited by examiner

*Primary Examiner* — Erin Deery
(74) *Attorney, Agent, or Firm* — Svendsen Legal, LLC.

(57) ABSTRACT

A powered, personal lifting apparatus, and specifically a lift apparatus, specially adapted for personal use in the entry into and exit from a standard bathtub. The apparatus includes an electric motor powered lifting gantry that slides on a pillar that extends from the floor to ceiling, next to the tub. The gantry raises or lowers an attached chair, or includes a sling. The gantry lowers a user into or out of the bathtub, while rotating automatically to provide for easy entry into or exit from the bathtub, with a locking guide for the gantry that utilizes a square-to round feature of the pillar to allow a 90 degree rotation of the gantry, and then lock it in place as it is lowered.

6 Claims, 8 Drawing Sheets

PERSONAL LIFT APPARATUS FOR USE WITH A BATHTUB

TECHNICAL FIELD

A powered, personal lifting apparatus, and specifically a lift apparatus, specially adapted for personal use in the entry into and exit from a standard bathtub. The apparatus includes an electric motor powered lifting crane that can raise and lower a gantry with a chair attached, or including a sling, with the chair or sling able to receive a person. The gantry lowers into and out of the bathtub, while rotating automatically to provide for easy entry into or exit from the bathtub.

BACKGROUND OF THE INVENTION

Bathing is a difficult or nearly impossible task for the disabled or in-firmed person, especially if the person is attempting to enter or exit a conventional bathtub and without assistance, the act of bathing in a tub is infeasible. Doors, rails, and steps are well-known solutions to ease access into bathtubs and curbed showers. However, any new installation of an accessibly designed bathtub that requires the demolition and removal of the existing showers or bathtubs is typically expensive and labor intensive. Additionally, the replacement, 'disabled-person accessible' type of bathtub or shower is often very expensive and complex to operate. A simplified, 'kit' or retrofit-able system is needed that efficiently modifies an existing bathtub and shower installations, to provide a water bathing lift system having an easy to use, mechanically assisted access for persons with limited mobility, especially those persons confined to a wheelchair or requiring a walker.

The following is a disclosure of the present invention that will be understood by reference to the following detailed description taken in conjunction with the accompanying drawings.

Figure 1:
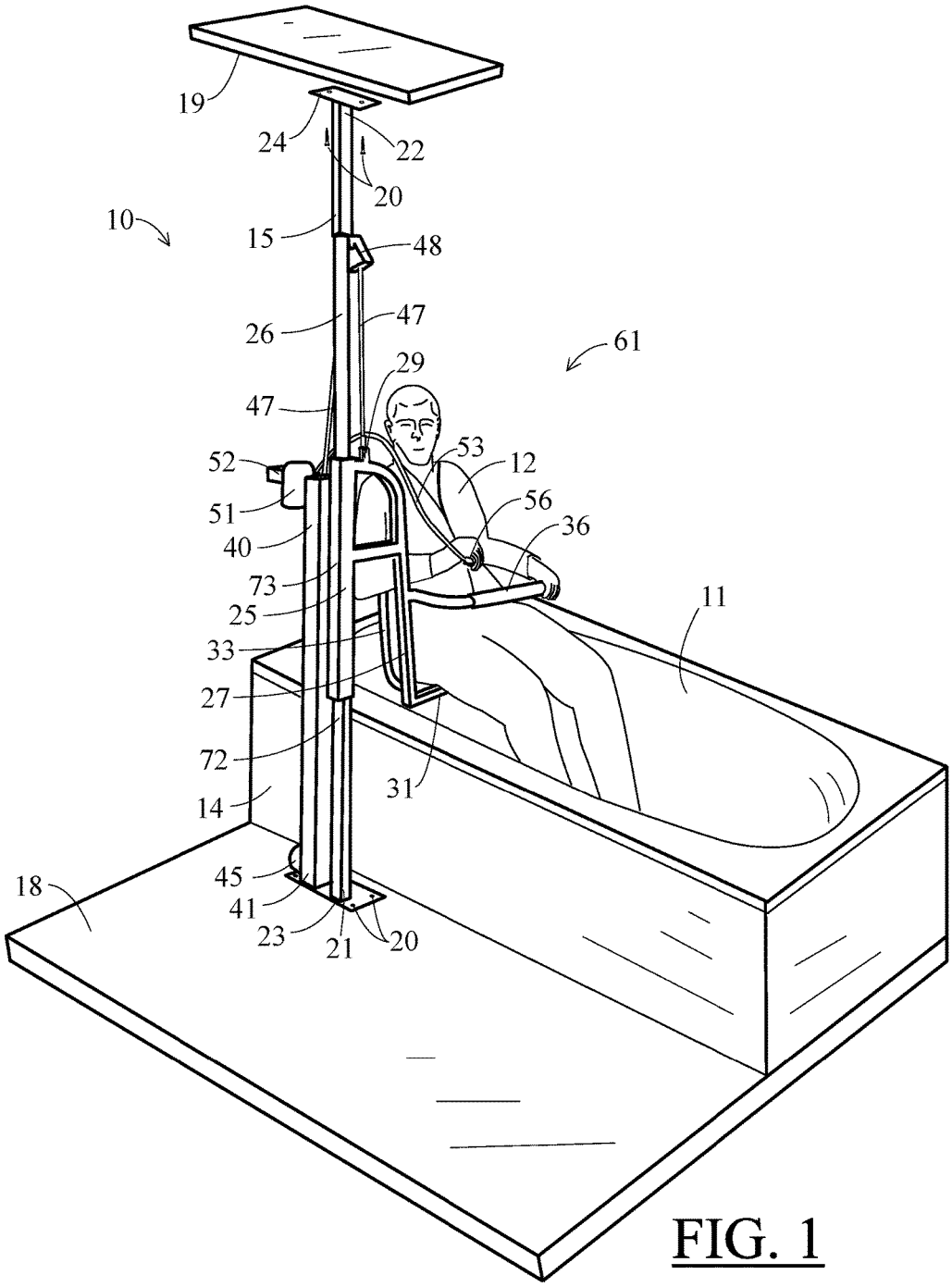
FIG. 1 is a perspective view of a personal lift apparatus, according to an embodiment of the invention.

Reference characters included in the above drawings indicate corresponding parts throughout the several views, as discussed herein. The description herein illustrates one preferred embodiment of the invention, in one form, and the description herein is not to be construed as limiting the scope of the invention in any manner. It should be understood that the above listed figures are not necessarily to scale and that the embodiments are sometimes illustrated by fragmentary views, graphic symbols, diagrammatic or schematic representations, and rotation lines. Details that are not necessary for an understanding of the present invention by one skilled in the technology of the invention, or render other details difficult to perceive, may have been omitted.

DETAILED DESCRIPTION OF SPECIFIC EMBODIMENTS

The invention provides a personal lift apparatus for use in bathing or showering. The apparatus of the present invention it may be employed to retrofit almost any bathing type of tub, bathtub, or similar functioning enclosure that collects or holds water for personal bathing purposes. These types of bathing enclosures or 'tubs' are referred to herein generally as bathtubs, or as a bathtub in a singular reference.

For people with disabilities, bathtubs are often difficult, if not impossible, to enter and exit. Doors, rails and steps are well-known solutions to easing access to bathtubs and curbed showers. However, new installations that require the demolition and removal of existing showers or bathtubs are expensive and labor intensive. Additionally, the replacement, 'disabled-person accessible' types of bathtubs or showers are often very expensive and complex to operate. The apparatus and method of the present invention provides a simplified, 'kit' bathtub retrofit system that efficiently augments existing tub and shower installations, providing a mechanized apparatus and system that is easily operated to accommodate any user, especially persons with limited mobility, or confined to wheelchairs or walkers.

For many elderly and homebound persons, the fear of falling rules out the luxury of bathing and its therapeutic benefits. These risks make bathing and showering impossible in the privacy of a home or residence, especially while unattended. For actuated bathing lift systems, AC power is often employed, which is inherently unsafe in wet environments. The present invention includes a DC powered bathing lift that offers more than just safe bathing. The lift apparatus of the present invention easily utilizes an existing bathtub, saving thousands of dollars in costly remodeling expenses.

A preferred embodiment of a personal lift apparatus 10 is shown in FIGS. 1 through 10. As shown in a preferred embodiment of FIG. 1, the personal lift apparatus is installed to serve a bathtub 11. The personal lift apparatus can be easily packaged in a kit, which can be installed to accommodate most existing bathtubs. Conventionally, the bathtub, which can simply be referred to as a 'tub,' is more generally a simple bathing or showing enclosure that is surrounded by a side-wall 14, as shown in FIGS. 1 through 5. As typical, the bathtub may be fabricated out of a metal, a fiberglass material, or alternatively an enamel or a ceramic coated metal, or a plastic.

Specifically, the personal lift apparatus 10 of the present invention is installed approximately adjacent to the bathtub, as shown in FIG. 1, with a pillar bar 15 mounted between a bathroom floor 18 and a bathroom ceiling 19, external to the bathtub.

The terms "approximately" or "approximate" are employed herein throughout, including this detailed description and the attached claims, with the understanding that the terms denote a level of exactness as typical for the skill and precision in the generally applicable field of technology, and well known to those persons knowledgeable or skilled in the design and installation of lifts for bathing tubs and related devices.

The personal lift apparatus 10 of the present invention efficiently augments existing bathtub 11, to provide a personal lift featuring easy access for a person or a user 12 with limited mobility, especially those persons or users requiring wheelchairs or walkers. Without the personal lift apparatus, the user wishing to enter into the bathtub must step-over or 'clear' the side-wall of the bathtub.

As also shown in FIG. 1, the personal lift apparatus 10 includes a pillar 15 that extends from a floor 18 to a ceiling 19, typically the floor and ceiling are external to the tub, and are structural components of a bathroom or shower area, or similar area of a residence, residential facility or institution. The pillar includes a pillar base 21 and a pillar top 22, with the pillar mounted in an approximately vertical orientation, as shown in FIG. 1. The pillar base attaches to the floor at a base plate 23 that is most preferably screwed to the floor and supporting floor structure beneath the personal lift apparatus. Similarly, the pillar top attaches to the ceiling at a top plate 24 that is most preferably screwed to the ceiling and supporting ceiling or roof structure above the personal lift apparatus. Screws 20 for mounting the top plate and to the ceiling and similarly the bottom plate to the floor are shown in FIG. 1. Additionally, a screw extension can be included in the pillar, to raise and lower the pillar to fit most ceiling heights.

As shown in FIGS. 1 through 5, a gantry 25 mounts movably on the pillar 15 of the personal lift apparatus 10. The gantry actuates mechanically, to move up and down upon the pillar. Specifically, the gantry includes a pillar tube 26 that receives the pillar within it, as detailed in FIG. 6B. The gantry also includes a gantry arm 27 and a cable mount 29. The gantry arm extends horizontally and then downwardly from the pillar tube. The gantry arm includes a tub-wall saddle that can over-arch the side-wall 14 of the bathtub 11, and then terminates at a base-bar 31, which is approximately horizontal and able to receive a chair 33 for receiving the user 12. The chair stores easily within or out of the tub.

Alternatively, the chair 33 can be replaced with a sling 34, to allow for the transfer of an non-ambulatory person with the personal lift apparatus 10. Preferably, when used with the chair, a grab-bar 36 also extends from the gantry arm 27, approximately parallel to and above the base-bar 31, as shown in FIG. 1 through 5. The grab-bar is preferably an ADA (American's with Disabilities Act) Design Standards compliant secure safety bar. Most preferably, the grab bar can be raised or tilted, allowing the user 12 to easily sit into or move out of the chair.

As shown in FIGS. 1 through 5, an actuator tower 40 is mounted approximately parallel to the pillar 15. The actuator tower includes a tower base 41 proximate to the floor 18, and a tower top 42 proximate to a halfway point between the floor and the ceiling 19 of the bathroom. The tower base of the actuator tower mounts to the floor 18, proximate to the pillar base 21. Preferably, the tower base and the pillar base can be combined into one element, as shown in FIG. 1. The actuation of the gantry into and out of the bathtub 11 is accomplished by the action of a motor 45, preferably located proximate to the pillar base, as shown in FIG. 1-5.

The motor 45 is preferably a direct-current (DC) powered electrical motor. DC power is preferred for the motor, in that any potential shock hazard is minimized. A preferred motor is a conventional 12V to 18 V type of DC servo motor with a 4 mm per second speed, a 450 mm stroke, and a minimum of a 4,500 Newton load capacity, which is sized to accommodate a user 12 weighing at least up to 425 pounds.

As shown in FIGS. 1 through 5, the motor 45 includes a cable spool (not shown) that winds or unwinds a lift cable 47. The lift cable routs up through the interior of the actuator tower 40 and then over a pillar pulley 48. The pillar pulley is mounted to the pillar 15 at an approximate midpoint between the level of the tower top 42 and the ceiling 19, as shown in FIG. 1. From the pillar pulley, the cable routs down to the cable mount 29 on the gantry 25.

Preferably, a control box 51 is mounted proximate to the tower top 42 as shown in FIG. 1. Most preferably, the control box includes a battery 52 and a control cable 53. The battery is preferably a replaceable and rechargeable DC type of battery, as conventionally used with rechargeable power tools, typically in the 12V to 24V range. The battery can be removed and recharged at a conventional charging station, as required. The control box supplies electrical power to the motor 45, in either a raising 'winding mode,' or a lowering 'unwinding mode' of operation.

Figure 2:
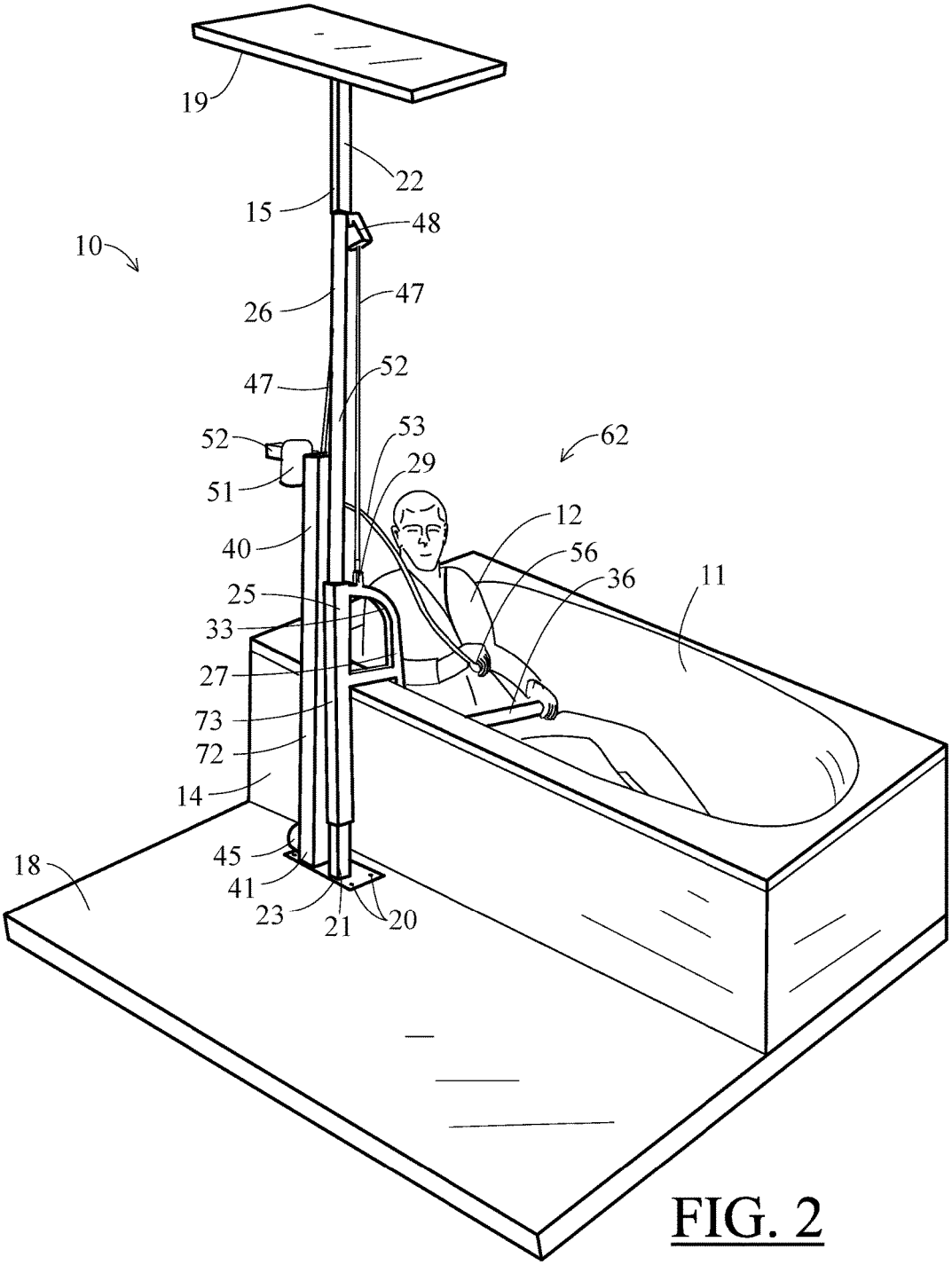
FIG. 2 is a perspective view of a personal lift apparatus, according to an embodiment of the invention.

The control cable routes from the control box to a remote switch 56. The user 12, either seated on the chair 33, or alternatively positioned external to the tub 11, can operate the remote switch of the control box 51 to control the actions of the gantry up and down the pillar tube 26 of the pillar 15. FIG. 1 shows the gantry in an "Over-Tub Intermediate" position 61. From the "Over-Tub Intermediate" position, the gantry can be lowered to an "Over-Tub Down" position 62, as shown in FIG. 2. As can be seen, the user is able to bathe in the tub or alternatively shower, if desired.

Figure 3:
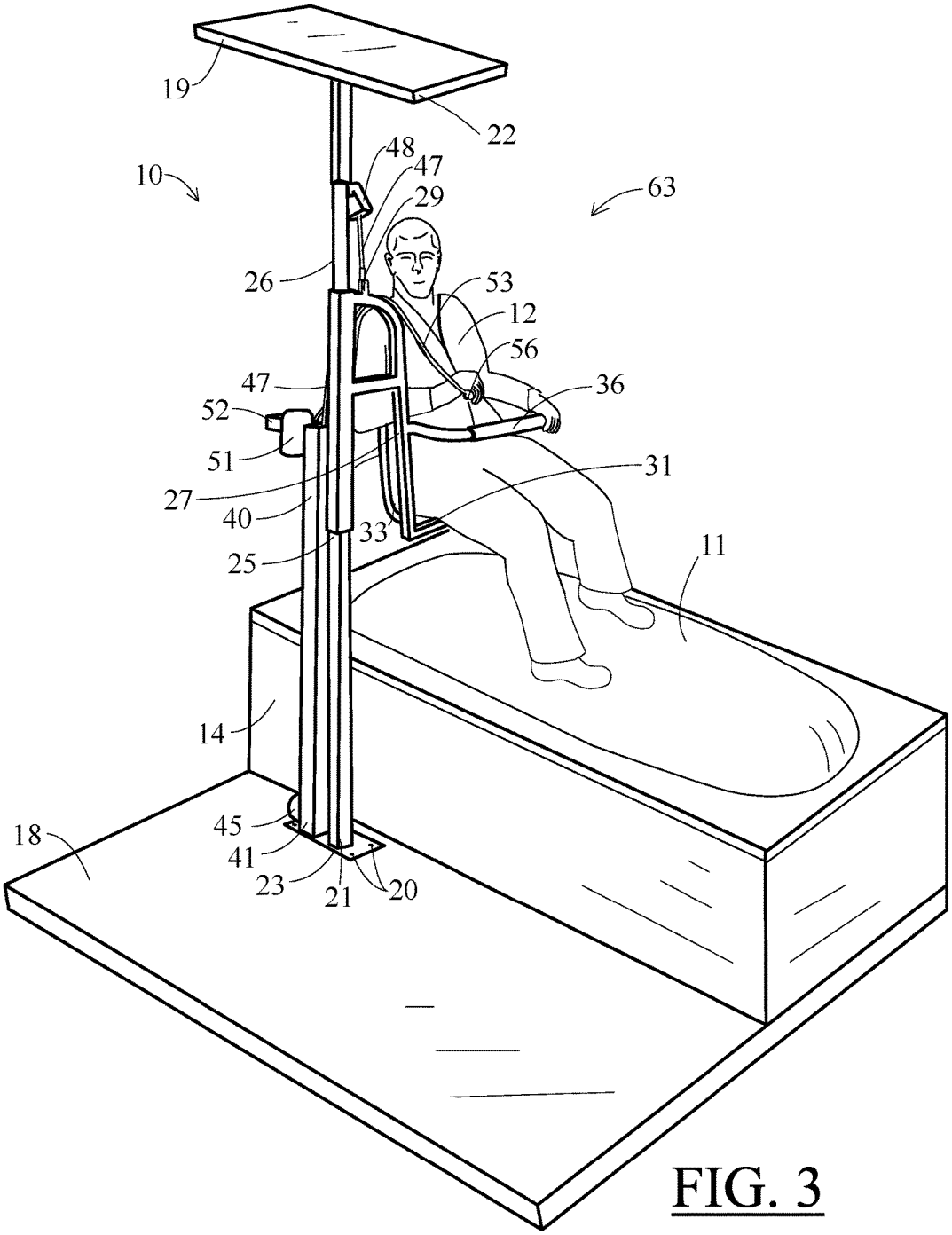
FIG. 3 is a perspective view of a personal lift apparatus, according to an embodiment of the invention.
Figure 4:
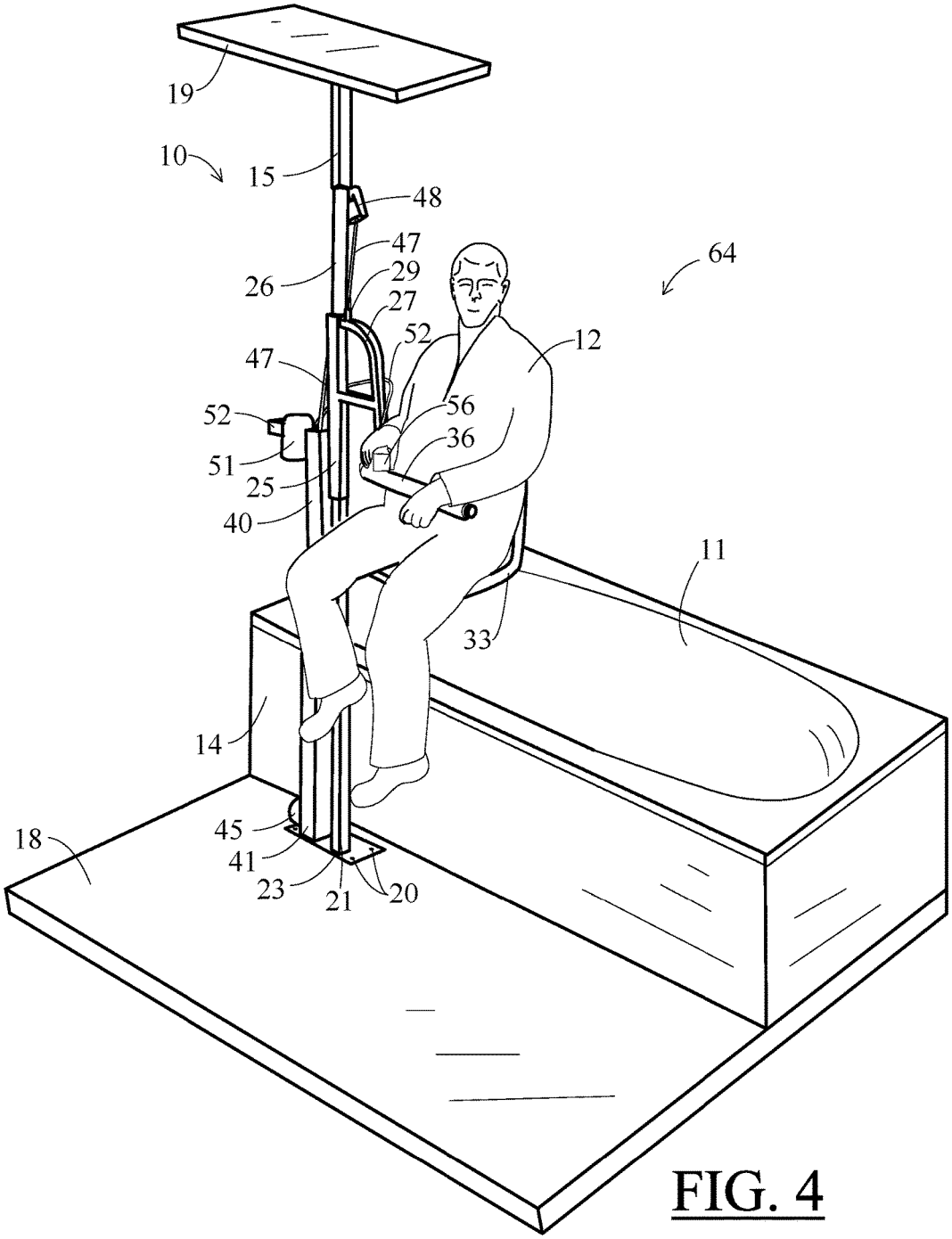
FIG. 4 is a perspective view of a personal lift apparatus, according to an embodiment of the invention.
Figure 5:
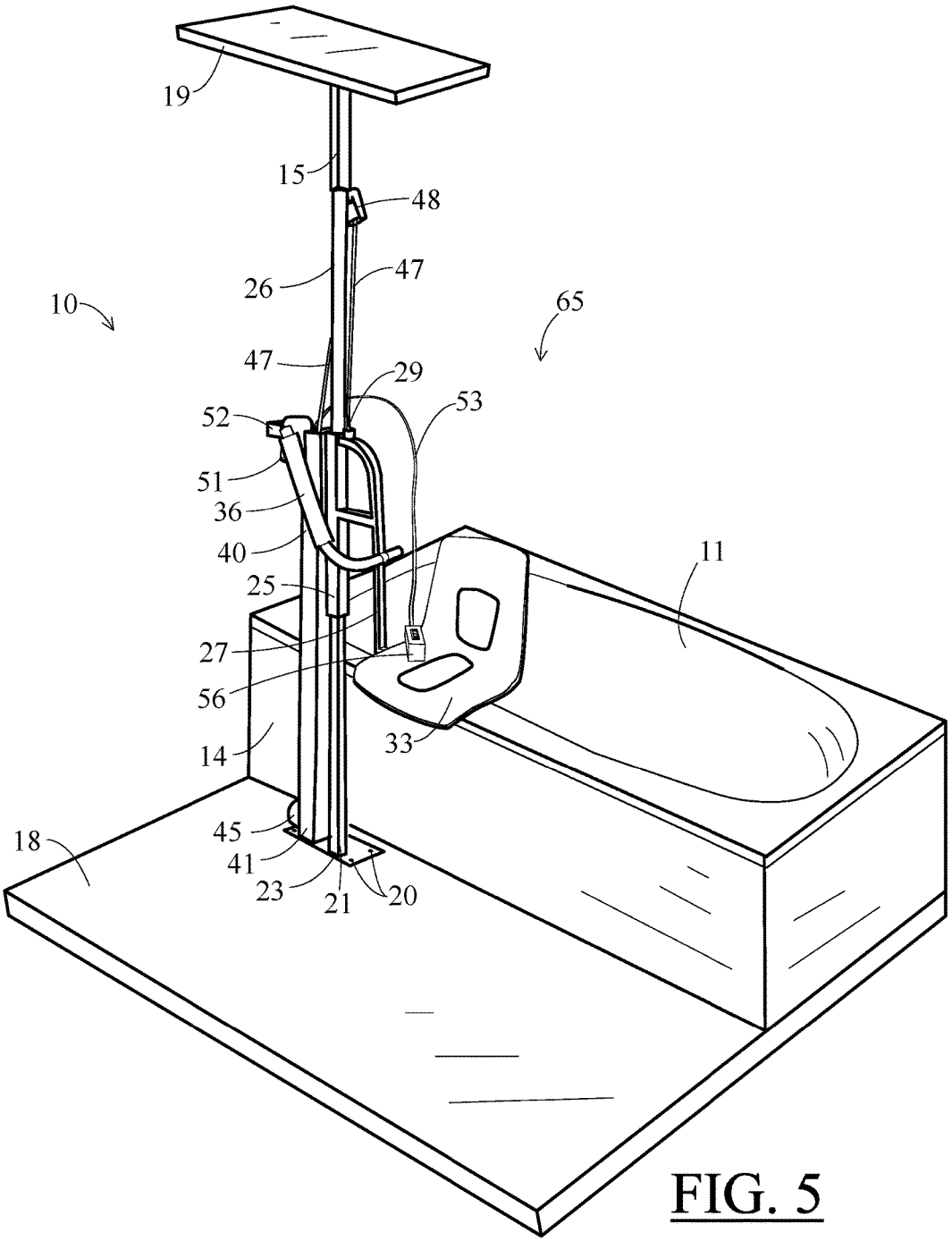
FIG. 5 is a perspective view of a personal lift apparatus, according to an embodiment of the invention.

From the "Over-Tub Down" position 62, the user can raise the gantry 25 with the remote switch 56 that is tethered to the control box 51, up to an "Over-Tub Up" position 63, as shown in FIG. 3. In the "Over-Tub Up" position, the gantry is free to pivot about the pillar 15 to an "Out-of-Tub Up" position 64, as shown in FIG. 4. As the gantry is lowered, it rotates and locks in the "Out-of-Tub Up" position and further lowers into an "Out-of-Tub Down" position 65, as shown in FIG. 5.

Figure 6A:
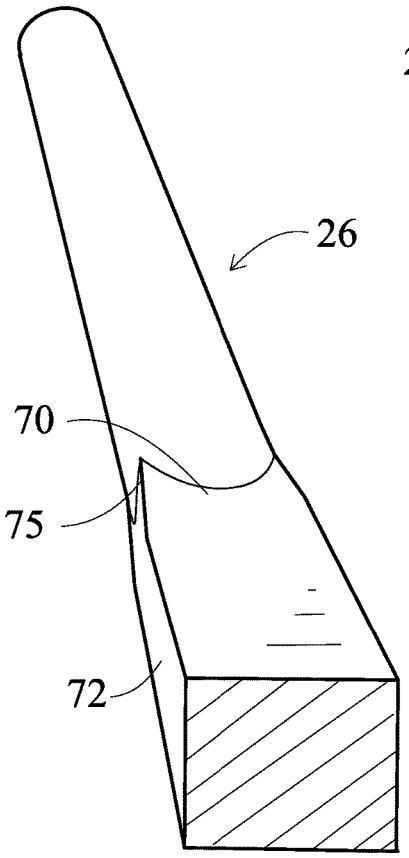
FIG. 6A is a partially sectioned perspective view of a portion of a pillar tube of a personal lift apparatus, according to an embodiment of the invention.

The smooth and reliable rotation of the gantry 25 from the "Over Tub Up" position 62 to the "Out of Tub Up" position 63 is critical to the operation of the personal lift apparatus 10 of the present invention. Therefore, an important feature of the personal lift apparatus is the locking action of the gantry, as it is alternately raised or lowered on the pillar 15. As shown in FIG. 6A, the pillar tube 26 within the pillar includes a "square-to-round" 70. The square-to-round includes a round tube 71 received within a square tube 72.

Figure 6B:
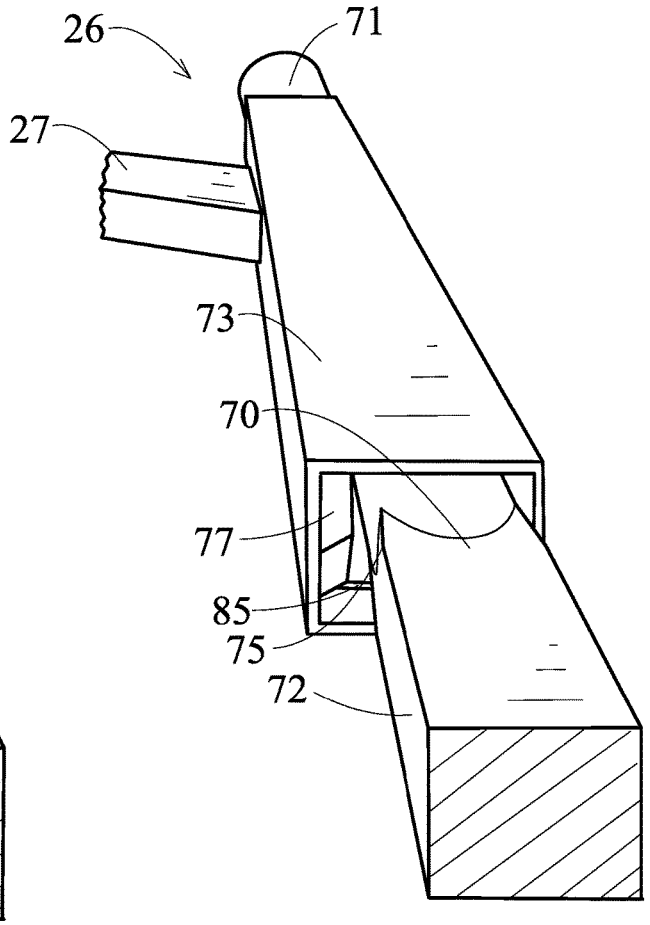
FIG. 6B is a partially sectioned perspective view of a portion of a pillar tube and gantry of a personal lift apparatus, according to an embodiment of the invention.

The gantry includes a gantry sleeve 73 that slides upon the pillar tube as shown in FIG. 6B. The gantry is free to move up and down the pillar tube, as shown in FIGS. 1 through 5, and discussed above.

Most preferably, the round tube 71 is offset within the square tube 72 of the pillar tube 26, as shown in FIGS. 7A through 8B. Specifically, a prow rib 75 is formed at the transition between the round tube and the square tube. Preferably, the prow rib is formed at a welded connection between the round tube and the square tube, which is then ground down to form the prominent "prow" rib. As shown in FIG. 6B, a prow guide 77 is placed within the gantry sleeve 73. The prow guide is preferably fabricated from a hard plastic or metal. A self lubricating plastic material, such as the brand Nylatron is most preferred. "Nylatron" is a tradename for a family of nylon plastics, typically filled with a molybdenum disulfide lubricant powder.

Figure 9A:
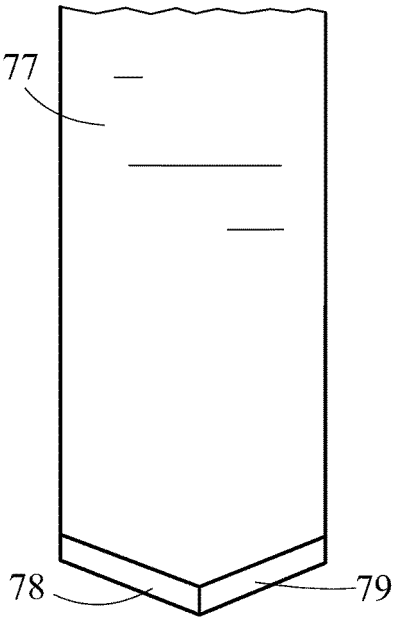
FIG. 9A is a front view of a portion of a prow guide of personal lift apparatus, according to an embodiment of the invention.
Figure 9B:
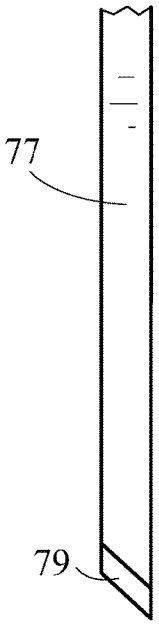
FIG. 9B is a side view of a portion of a prow guide of personal lift apparatus, according to an embodiment of the invention.
Figure 9C:
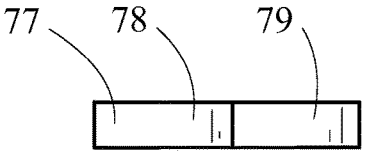
FIG. 9C is a bottom view of a portion of a prow guide of personal lift apparatus, according to an embodiment of the invention.
Figure 10:
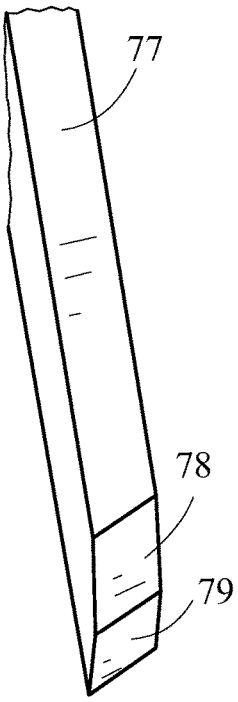
FIG. 10 is a perspective view of a portion of a prow guide of personal lift apparatus, according to an embodiment of the invention.

A preferred shape of the prow guide 77 is shown in FIGS. 9A through 10. The prow guide is received within the gantry sleeve 73 to abut against the square-to-round, as shown in FIG. 6B. The prow guide includes an "in-guide" surface 78 and an "out-guide" surface 79. The in-guide surface and the out-guide surface are inclined slightly as shown in FIG. 9B and angled as shown in FIG. 9A to guide the rotation of the gantry sleeve on the prow rib 75 on the square-to-round transition 70 of the pillar tube 26. As shown in FIGS. 9A and 10, the in-guide surface abuts to the out-guide surface, with the in-guide surface and the out-guide surface joined to form an approximate 'V-shape,' and with the in-guide surface and the out-guide surface inclined at approximately the same angle in addition to their approximately V-shape joining.

The action of the prow rib 75 of the pillar tube 26 against the prow guide of the gantry sleeve 73 is detailed in FIGS. 7A through 8B. These four FIGS. All view the pillar 15 from below and from the same perspective, and serve to illustrate the rotating action of the gantry on the pillar tube.

Figure 8A:
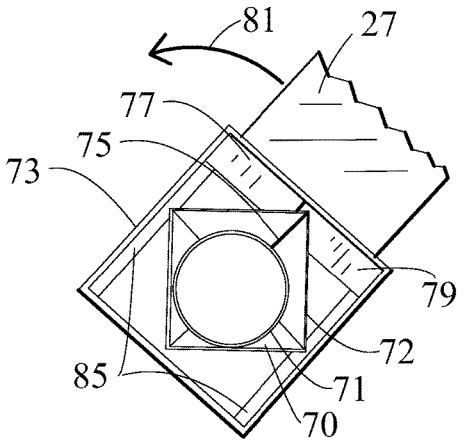
FIG. 8A is a partial bottom view of a portion of a pillar tube and gantry of a personal lift apparatus, according to an embodiment of the invention.
Figure 8B:
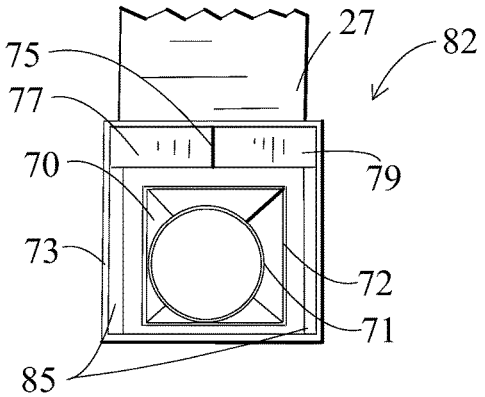
FIG. 8B is a partial bottom view of a portion of a pillar tube and gantry of a personal lift apparatus, according to an embodiment of the invention.

Specifically, as shown in FIG. 8A, when the prow rib 75 of the pillar tube 26 contacts the out-guide surface 79, the gantry 25 is forced to rotate in an outward direction 81 out from the tub, to an 'out' position 82, as shown in FIG. 8B, with the 'in' position at an approximately 90 degree angle to the 'out' position. Once the gantry is in the out position, it is rotationally locked, and free to move only up or down, to the "Out-of-Tub Up" position 64 or down to the "Out-of-Tub Down" position 65.

Figure 7A:
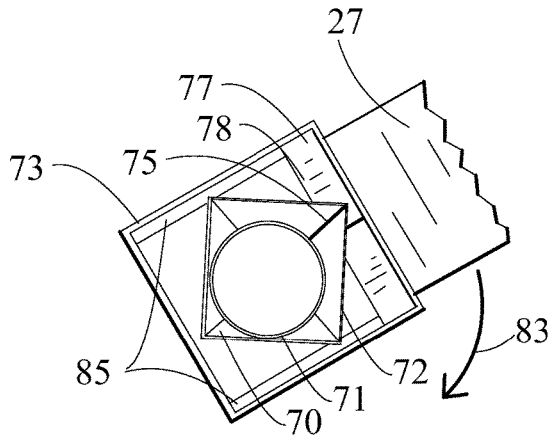
FIG. 7A is a partial bottom view of a portion of a pillar tube and gantry of a personal lift apparatus, according to an embodiment of the invention.
Figure 7B:
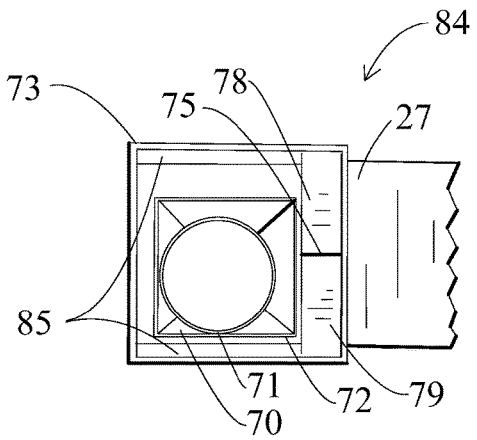
FIG. 7B is a partial bottom view of a portion of a pillar tube and gantry of a personal lift apparatus, according to an embodiment of the invention.

Likewise, as shown in FIG. 7A, when the prow rib 75 of the pillar tube 26 contacts the in-guide surface 78, the gantry 25 is forced to rotate in an inward direction 83 toward the tub, to an 'in' position 84, as shown in FIG. 7B. Once the gantry is in the in position, it rotationally locked, and free to move only up or down, to the "Over-the-Tub Up" position 63 or down to the "Over-the-Tub Down" position 62.

Additionally, as shown in FIGS. 7A through 8B. a pair of opposing bumpers 85 are preferably included within the gantry sleeve 73 to aid in the smooth rotation and sliding movement of the pillar tube 26 within the gantry sleeve. Like the prow guide 77, the pair of opposing bumpers are also preferably made from a Nylatron plastic.

Mounted beside the tub 11, the personal lift apparatus 10 raises the user 12 up and over the side-wall 14 of the bathtub with the simple push of a button on the remote switch 56. The gantry 25 automatically rotates over the tub where it can then be lowered partway to the Over-Tub Intermediate position 61, if the users only wishes to shower, or further lowered to the bottom of the tub to the Over-Tub Down position 62, if desired.

When the user 12 is finished with the shower or bath, the user simply pressed the up button on the remote switch 56 and the gantry 25 is raised so that the feet of the user clear side-wall 14 of the bathtub. The gantry automatically rotates again, placing the user's feet outside of the tub in the Out-of-Tub Up position 64. The user then presses the down button on the remote switch and lowers the gantry to rest, near the side-wall of the tub, in the Out-of-Tub Down position 65. The user may then lift the grab-bar 36 as shown in FIG. 5, and easily exit the chair 33 mounted on the gantry.

The personal lift apparatus 10 fits all standard bathtubs and showers, with easy custom modifications to accommodate most shapes and sizes of tub or shower enclosures. The personal lift apparatus is adaptable for either left-hand type or right-hand type of tubs, without requiring plumbing or structural changes. The personal lift apparatus fits all standard ceiling heights from 90 to 97 inches, with custom height extensions available, if needed. Installation and set-up of the personal lift apparatus is quick and easy, which makes the personal lift apparatus easily removable and portable to new locations. Importantly, the personal lift apparatus is able to comply with the egress specifications for wheelchairs, under the American's with Disabilities Act (ADA).

In compliance with the statutes, the invention has been described in language more or less specific as to structural features and process steps. While this invention is susceptible to embodiments in different forms, the specification illustrates preferred embodiments of the invention with the understanding that the present disclosure is to be considered an exemplification of the principles of the invention, and the disclosure is not intended to limit the invention to the particular embodiments described. Those with ordinary skill in the art will appreciate that other embodiments and variations of the invention are possible, which employ the same inventive concepts as described above. Therefore, the invention is not to be limited except by the following claims, as appropriately interpreted in accordance with the doctrine of equivalents.

The following is claimed:

1. A lift apparatus for personal use, the apparatus including:

a gantry for receiving and lifting a user, the gantry having a gantry sleeve, and a prow guide mounted within the gantry sleeve, the prow guide having an in-guide surface and an out-guide surface;

a pillar tube receivable into the gantry sleeve, the pillar tube having a round portion and a square portion, the round portion received within the square portion at a square-to-round transition, and the gantry raise-able and lower-able on the pillar tube;

the gantry sleeve slide-able upon the pillar tube;

a prow rib formed at the square-to-round transition between the round portion and the square portion of the pillar tube; and the in-guide surface angled to guide rotation of the gantry sleeve on the prow rib on the square-to-round transition of the pillar tube in a first direction of rotation of the gantry about the pillar tube, and the out-guide surface angled to guide rotation of the gantry sleeve on the prow rib on the square-to-round transition of the pillar tube in a second direction of rotation of the gantry about the pillar tube.

2. The lift apparatus of claim 1, wherein:

the in-guide surface abuts to the out-guide surface, the in-guide surface and the out-guide surface join to form an approximate V-shape, and the in-guide surface and the out-guide surface are inclined at approximately the same angle in addition to the approximate V-shape joining.

3. The lift apparatus of claim 1, wherein:

the prow rib of the pillar tube contacts the in-guide surface to force the gantry to rotate in the first direction and locking the gantry in a first position with the gantry free to move along the pillar; and the prow rib of the pillar tube contacts the out-guide surface to force the gantry to rotate in the second direction and locking the gantry in a second position, with the gantry free to move along the pillar.

4. A method for a personal lift apparatus comprising the following steps:

a) receiving a pillar tube within a gantry sleeve of a gantry, the gantry for receiving and supporting a user, the pillar tube having a round portion and a square portion, the round portion received within the square portion at a square-to-round transition, the square-to-round transition having a prow rib and the gantry raise-able and lower-able on the pillar tube, and a prow guide within the gantry sleeve, the prow guide having a first angled guide surface, and the first angled guide surface of the prow guide angled to guide rotation of the gantry sleeve on the prow rib on the square-to-round transition of the pillar tube in a first direction of rotation of the gantry about the pillar tube;

b) contacting the prow rib of the pillar tube to the first angled guide surface;

c) forcing the gantry to rotate in the first direction of rotation; and d) locking the gantry in a first locked position, with the gantry free to move along the pillar tube; and e) lowering the gantry on the pillar tube.

5. The method for a personal lift apparatus of claim 4, additionally including the steps of:

f) raising the gantry on the pillar tube;

g) contacting a second angled guide surface of the prow guide with the prow rib of the pillar tube, the second angled guide surface of the prow guide angled to guide rotation of the gantry sleeve on the prow rib on the square-to-round transition of the pillar tube in a second direction of rotation of the gantry about the pillar tube;

h) forcing the gantry to rotate in the second direction of rotation;

i) locking the gantry in a second locked position, with the gantry free to move along the pillar tube; and j) lowering the gantry on the pillar tube.

6. A method for a personal lift apparatus consisting essentially of the following steps:

a) receiving a pillar tube within a gantry sleeve of a gantry, the gantry for receiving and supporting a user, the gantry raise-able and lower-able on the pillar tube, the pillar tube having a round portion and a square portion, the round portion received within the square portion at a square-to-round transition, the square-to-round transition having a prow rib, and a prow guide within the gantry sleeve, the prow guide having a first angled guide surface and a second angled guide surface, the first angled guide surface of the prow guide angled to guide rotation of the gantry sleeve on the prow rib on the square-to-round transition of the pillar tube in a first direction of rotation of the gantry about the pillar tube, and the second angled guide surface of the prow guide angled to guide rotation of the gantry sleeve on the prow rib on the square-to-round transition of the pillar tube in a second direction of rotation of the gantry about the pillar tube b) contacting the prow rib of the pillar tube to the first angled guide surface;

c) forcing the gantry to rotate in the first direction of rotation;

d) locking the gantry in a first locked position, with the gantry free to move along the pillar tube;

e) lowering the gantry on the pillar tube;

f) raising the gantry on the pillar tube;

g) contacting the prow rib of the pillar tube to the second angled guide surface;

h) forcing the gantry to rotate in the second direction of rotation;

i) locking the gantry in a second locked position, with the gantry free to move along the pillar tube; and j) lowering the gantry on the pillar tube.

* * * * *